US005910037A

United States Patent [19]

Bach et al.

[11] Patent Number: 5,910,037

[45] Date of Patent: Jun. 8, 1999

[54] TOY BUILDING SYSTEM

[75] Inventors: Erik Bach; Kaj Svejstrup Mikkelsen, both of Billund; Carsten Peter Michaelsen, Vejle; Philip Marshall Kushner, Greve, all of Denmark

[73] Assignee: INTERLEGO AG, Baar, Switzerland

[21] Appl. No.: 08/752,535

[22] Filed: Nov. 20, 1996

Related U.S. Application Data

[XX .

[60] Provisional application No. 60/006,973, Nov. 20, 1995.

[51] Int. Cl.[6] ..... A63H 33/06; G09B 25/00

[52] U.S. Cl. ..... 446/108; 446/110; 446/118; 446/124; 434/80

[58] Field of Search ..... 446/105, 108, 446/110, 117, 118, 124, 125, 482; 434/80

[56] References Cited

FOREIGN PATENT DOCUMENTS

| | | | |
|---|---|---|---|
| 148274 | 5/1949 | Australia | 446/110 |
| 512760 | 11/1992 | European Pat. Off. | 446/482 |
| 1086061 | 1/1956 | France | 446/124 |
| 2405530 | 6/1979 | France | 446/80 |
| 404163572 | 6/1992 | Japan | 434/80 |
| 1212537 | 11/1970 | United Kingdom | 446/125 |
| 2042017 | 9/1980 | United Kingdom | 446/124 |
| 2196773 | 5/1988 | United Kingdom | 446/105 |
| 8604253 | 7/1986 | WIPO | 446/124 |

*Primary Examiner*—Robert A. Hafer
*Assistant Examiner*—Laura Fossum
*Attorney, Agent, or Firm*—Kane,Dalsimer,Sullivan,Kurucz, Levy, Eisele and Richard, LLP

[57] ABSTRACT

A toy building system for the construction of e.g. in-door settings and furniture element groupings, comprising a number of substantially box-shaped fittings (1,2,3) with a top surface, a bottom surface and a number of lateral walls, comprising a front with furniture-like functional parts, such as doors, shelves, etc., and a back (4) with coupling means (5,6) and wherein each fitting (1,2,3) has at least two functionally identical coupling means (5,6), said coupling means (5,6) comprising coupling means (5) that protrude a distance from the back (4) of the fitting (1,2,3), and wherein the coupling means (5,6) are arranged at a mutual modular distance and provided in such a manner that the fittings (1,2,3) may be interconnected back (4) to back (4) in at least two different positions relative to each other.

10 Claims, 8 Drawing Sheets

TOY BUILDING SYSTEM

This application claims benefit of provisional application Ser. No. 60/006,973 filed Nov. 20, 1995.

The present invention relates to a toy building system for the construction of e.g. in-door settings and furniture element groupings comprising a number of substantially box-shaped fittings with a top surface, a bottom surface, and a number of lateral surfaces including a front with furniture-like functional parts, such as doors, shelves, etc., and a back provided with coupling means.

Such system is known from GB patent application No. 2,196,773 where the coupling means arranged at the back of the fittings consist of a horizontal tongue, and where the system comprises a number of wall elements with complementary, horizontal grooves for receiving the horizontal tongue on the fitting. This allows for a flexible construction of an in-door setting, as the wall elements may be interconnected in a variety of ways, and since the furniture may subsequently be mounted anywhere in the horizontal grooves on the wall elements.

The play value of this known toy building system is thus increased compared to conventional, inseparably assembled fittings, since a variety of different in-door settings may flexibly be constructed with a given number of wall elements and fittings.

In the light of this, it is the object of the present invention to provide a toy building system as defined in the introductory part of claim 1 and which further enables the construction of e.g. in-door settings and furniture element groupings without necessitating wall elements therefor as it is known from the prior art disclosure GB patent application No. 2,196,773. This is obtained with the features claimed in claim 1 by each fitting having at least two functionally identical coupling means, said coupling means comprising coupling elements which protrude a distance from the back of the fitting, and where the coupling means are arranged at such a mutual modular distance and are so designed that the fittings may be interconnected in a variety of positions relative to each other.

This means that two fittings may be interconnected e.g. back to back thereby eliminating the need for an interjacent wall element as is the case with the prior art. Hereby it is also possible to construct in-door settings and furniture element groupings which, all things being equal, become less space-intensive since no space is occupied by a wall element. Moreover it is possible to combine the fittings partially overlapping each other back to back, in a number of different positions relative to each other, whereby an entire wall may be constructed which consists of individual fittings which are secured by mutual displacement thereof prior to interconnecting.

In claim 2 and claim 3, respectively, it is defined that the coupling means are arranged at a mutually fixed modular distance along at least one line which is substantially parallel with the lateral surfaces situated adjacent to the back, or with the top surface or the bottom surface of the fitting. Thus, the embodiment according to claim 2 makes it possible to combine the individual fittings by horizontal brick-like bonding, and the features of claim 3 allows for interconnecting the fittings by vertical brick-like bonding.

As described in claim 4, the fittings may comprise at least four sets of functionally identical coupling groups arranged in a rectangular pattern which allows the individual fittings to be interconnected by vertical, horizontal or diagonal brick-like bonding relative to the rectangular patterns, since the coupling groups are functionally identical.

It results from the arrangement of the coupling groups whereby, in substance, the distance from a coupling group to the most proximate surface which abuts on the back in a given modular arrangement corresponds to half the modular distance in this modular direction as defined in claim 4, that the lateral surfaces which abut on the back of the fittings and face each other will be very close.

According to the preferred embodiment defined in claim 6 the coupling means on the backs of the fittings are made to be self-complementary, which means that two fittings with identical coupling means may be interconnected at their backs. The term self-complementary coupling is used to designate coupling means of the type which may be completely identically shaped and which may yet be interconnected.

The toy building element may according to claim 7 further comprises a number of wall elements where the fittings and the wall elements are provided with mutually complementary coupling means arranged for releasable coupling of the fittings onto the wall elements. This allows for the construction of in-door settings or furniture element groupings where e.g. upper cupboards and lower cupboards are used without the possibility of combining these in a brick-like manner with other fittings, e.g. if the only fittings desired are those with furniture-like functional elements facing to the same side.

The toy building system may further comprise a number of building plates as given in claim 8, wherein the bottom surfaces of the fittings and the building plates have mutually complementary coupling means arranged for releasable coupling of the fittings onto the building plates.

Claim 9 defines a particularly advantageous embodiment where the coupling means for interconnecting the fittings and the coupling elements for coupling the fittings onto the wall elements in the modular direction parallel to the underside of the building plates, have the same modular distance as the coupling means on the building plates. With such uniformity in the modular distances in the different coupling means, it becomes substantially more easy to interconnect the individual elements, and additionally several coupling systems may be functioning at the same time.

Claim 10 defines a further convenient embodiment where the wall elements and/or the building plates constitute a portion of the doll's house construction From an overall point of view it will thus be possible to impart to the toy building system an extremely flexible applicability since it is possible to use it for constructing in-door settings as well as furniture element groupings without the use of wall elements, and at the same time the construction of more comprehensive in-door settings and furniture element groupings does not preclude the use of wall elements or building plates, which wall elements or building plates may also constitute a part of an entire doll's house construction. Thus, the toy building system may be supplemented over time and expanded by acquisition of more elements which may be used for the construction of increasingly complex constructions.

The invention will now be described in further detail with reference to the drawings, wherein:

FIGS. 1, 2, and 3 describe different embodiments of the fittings according to the invention.

Figure 1:
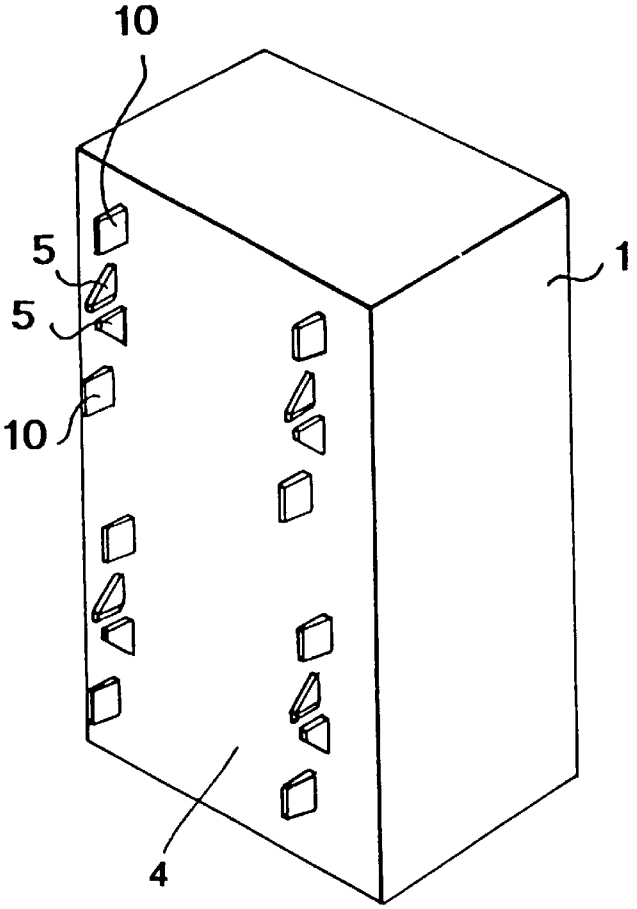

Thus, FIG. 1 is a perspective view of a box-shaped fitting 1 having on the back 4 four identical sets of coupling means that each consists of two coupling studs 5 and two coupling flanges 10.

If two fittings of this type which is shown in FIG. 1 are combined with their backs 4 towards each other, the coupling studs 5 on the one element will frictionally engage the coupling studs 5 on the second element, thereby interconnecting the two fittings 1 back to back.

Figure 2:
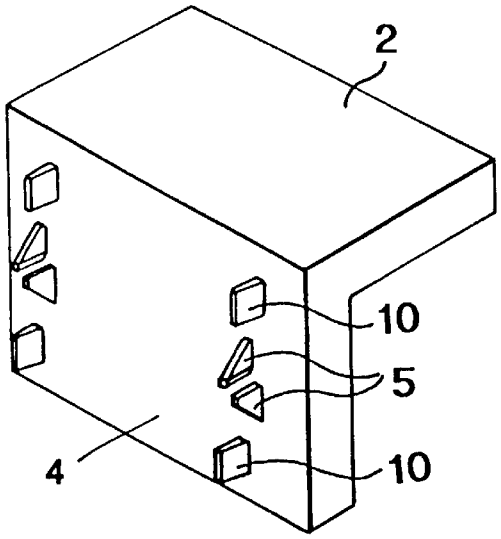

A wide variety of embodiments of the fitting are perceivable, and FIG. 2 illustrates a fitting 2 which, like the fitting shown in FIG. 1, is provided with coupling means consisting of coupling studs whereby the fitting 2, in this example a shelf element, may be mounted with its back 4 towards the back 4 of the fitting 1. As will appear, the shelf element 2 may be mounted at the top or at the bottom of the furniture element 1, the distances between the individual groups of coupling elements being modularized.

Figure 3:
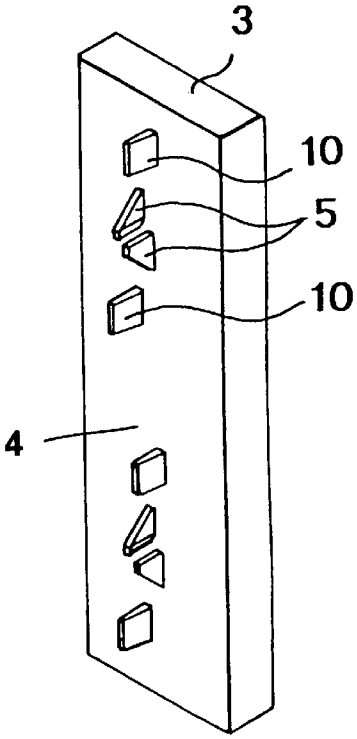

FIG. 3 illustrates a third embodiment where the fitting, in this example a cover plate, is also provided with coupling studs 5 arranged in two groups one above the other, and where the coupling studs and the coupling apertures may thus engage with coupling studs on e.g. the fitting 1 as shown in FIG. 1.

The building system may further comprise a wall element provided with coupling studs 6 wherein the coupling studs 5 and the coupling flanges 10 on the fittings may be introduced.

In order to obtain as smooth a surface as possible on the wall element, the wall element is not provided with protruding coupling elements but only with coupling apertures which extend into the surface of the wail element.

In the embodiment shown, the coupling studs 5 and the coupling flanges 10 will extend into the grooves 6, when a fitting is mounted on the wall element 7. The coupling studs 5 will in that position only be touching the bottom 11 of the grooves 6, and the coupling flanges 10 will forceably engage the sides of the grooves 6 in such a way that the fitting is slidable along the grooves 6.

The bottom 11 of the grooves is provided with a number of protrusions 12 which will engage the coupling studs 5 such as to give a click marking when the coupling studs 5 slide over the protrusions 12.

Figure 4:
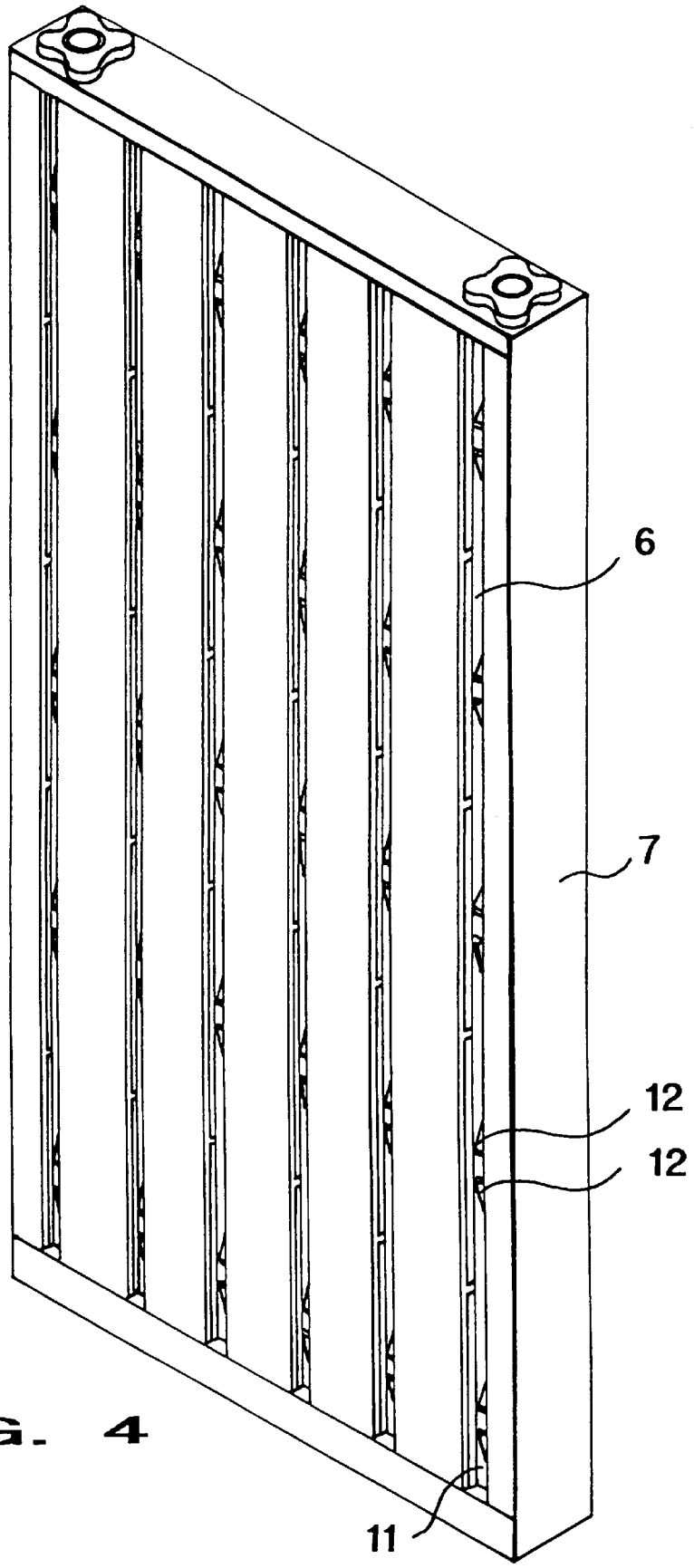
FIG. 4 illustrates a wall element for the toy building system.
Figure 5:
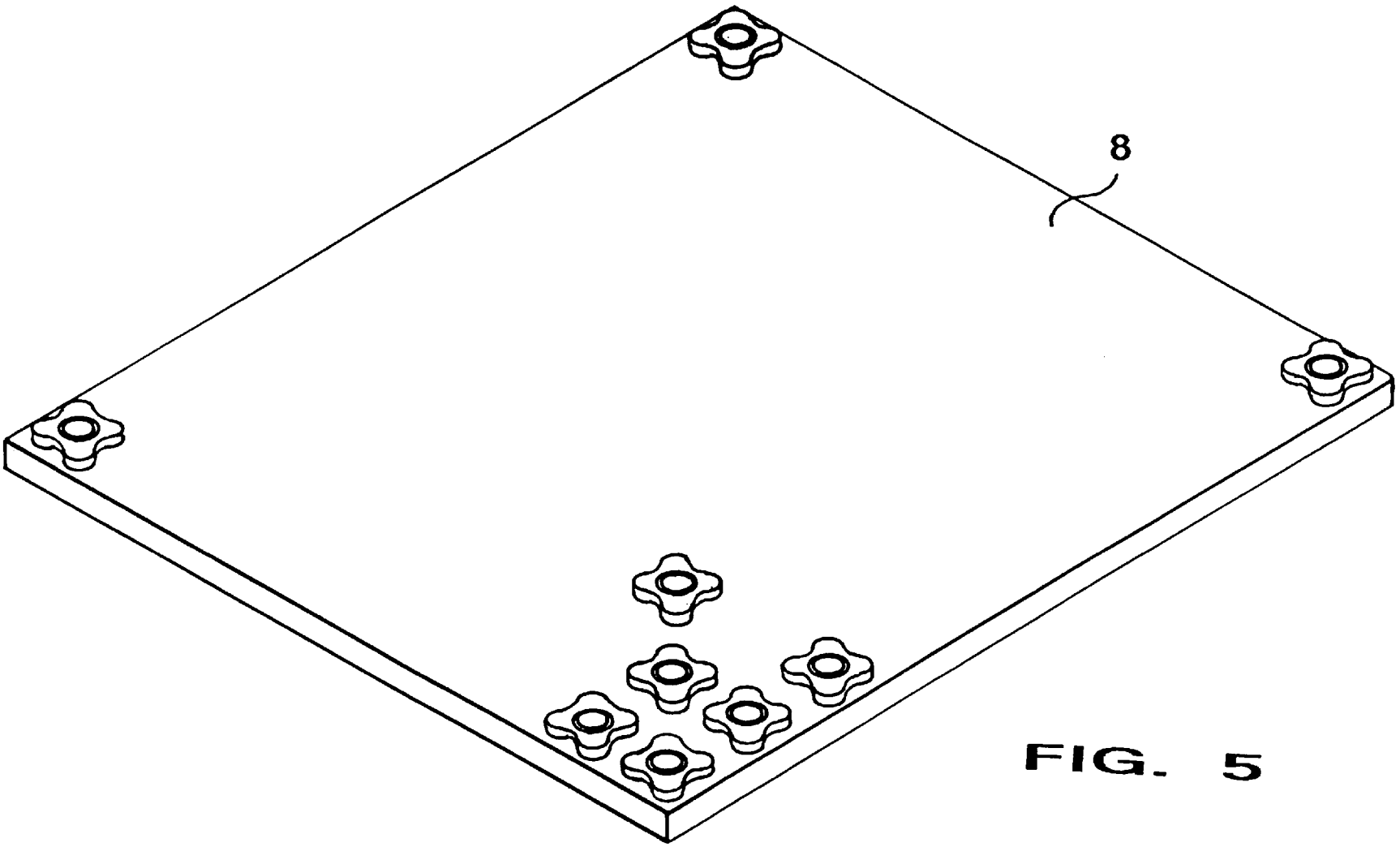
FIG. 5 illustrates a bottom plate for the toy building system.

The building system may further comprise a building plate 8 as shown in FIG. 5 which is provided in a manner known per se with coupling studs which may engage with complementary coupling elements on e.g. the fitting 1 in FIG. 1 and/or the wall element 7 in FIG. 4.

Figure 6:
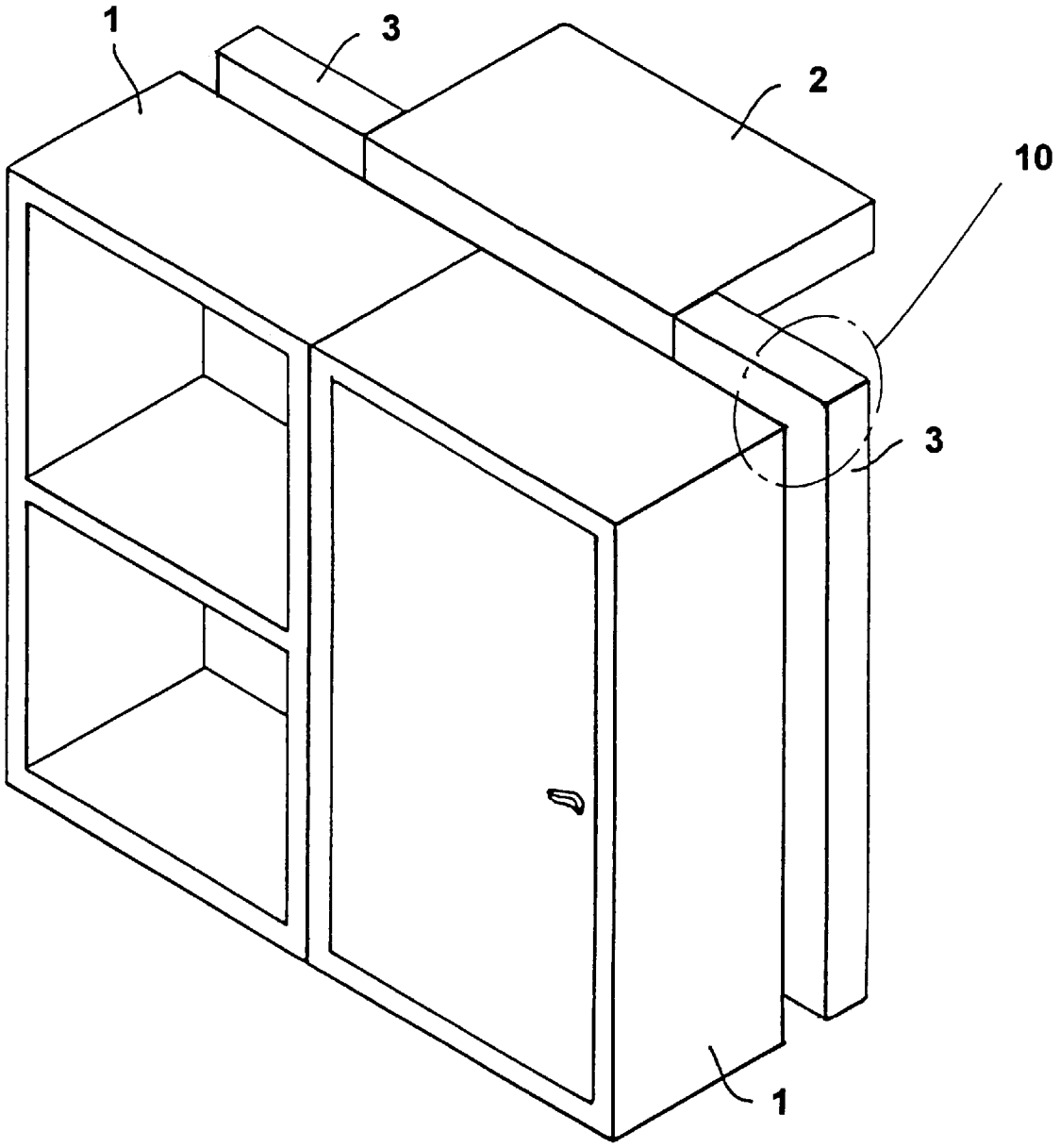
FIG. 6 illustrates a furniture element grouping constructed from fittings.

Thus the invention enables the construction of furniture element groupings which consist exclusively of fittings, as will appear from FIG. 6 which illustrates a furniture element grouping constructed from two elements 1 which correspond to the fitting 1 in FIG. 1, but where the one element constitutes a shelf element and the second one a cupboard with a door. In the manner described above the back of these two elements 2 are provided with a shelf element 2 corresponding to the shelf element 2 in FIG. 2, and two cover elements 3 which correspond to the cover element 3 according to FIG. 3.

Although FIG. 6 illustrates a space between the backs 4 of mating elements, it will be appreciated that the configuration of coupling studs 5 may be chosen to permit elements to be mounted back-to-back so that the backs 4 abut, the back 4 of one element being substantially flush with the back 4 of another element. The space between elements 1, 1 and elements 3, 2, 3 is substantially equal to the height of coupling studs 5 and coupling flanges 10.

Figure 9:
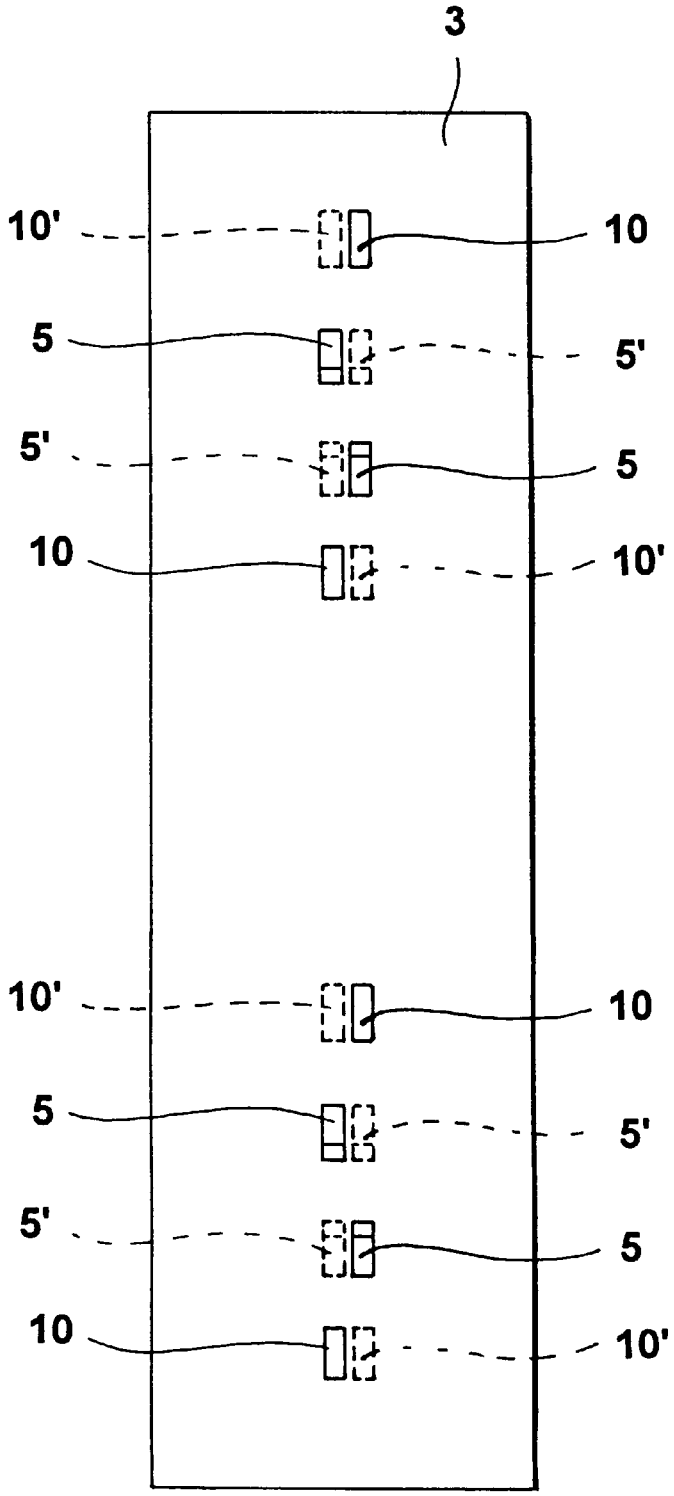
FIG. 9 is a front elevational view of the back of the fitting shown in FIG. 3 illustrating the coupling studs and coupling flanges coupled with the coupling studs and coupling flanges of another fitting shown in phantom.
Figure 10:
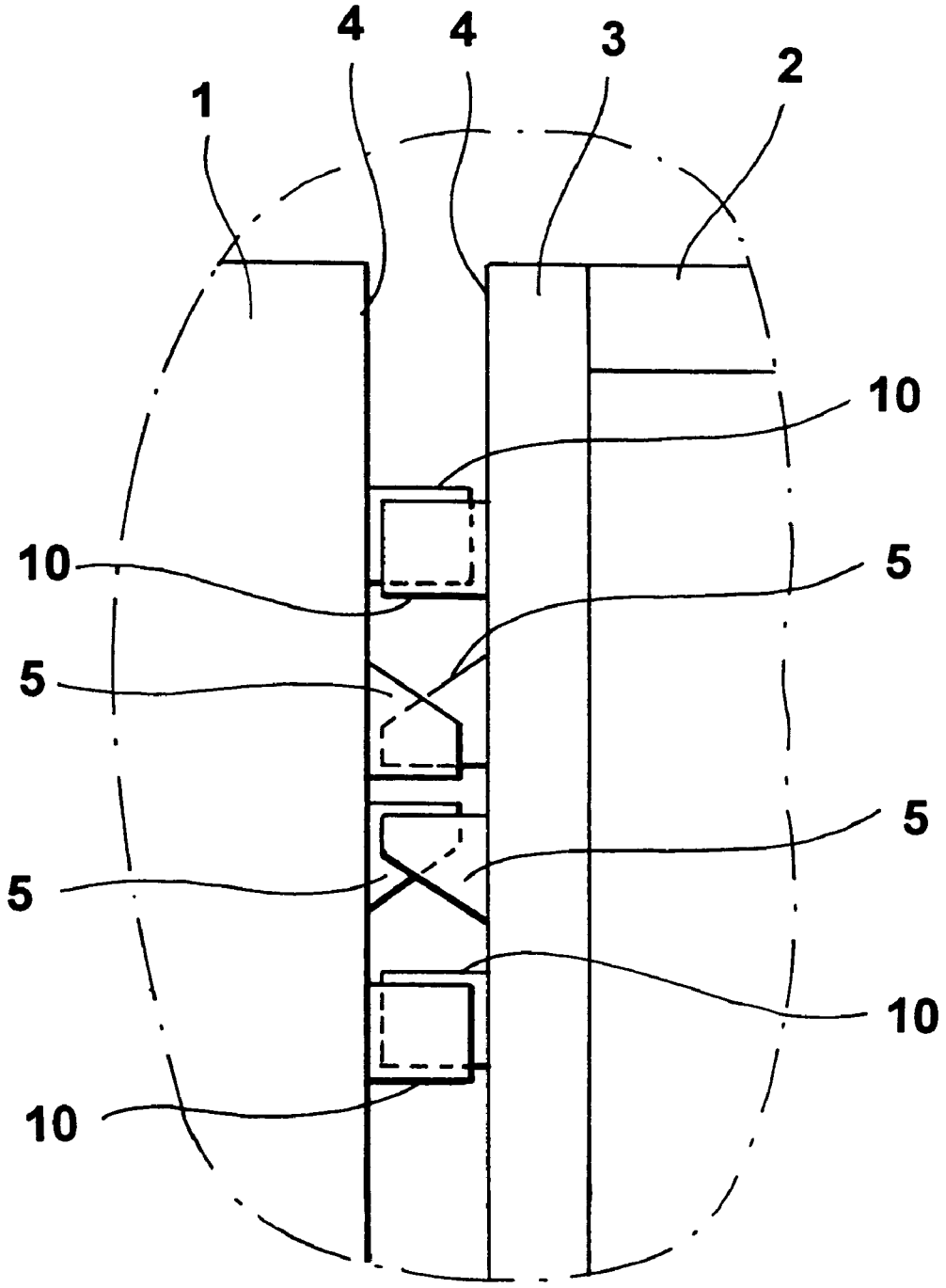
FIG. 10 is a partial side elevational view illustrating coupling studs and coupling flanges of two fittings shown in FIG. 6 coupled back-to-back.

FIG. 9 is a front elevational view of coupling studs 5 and coupling flanges 10 of the wall element 3 illustrated in FIG. 3 respectfully coupled with coupling studs 5' and coupling flanges 10' of another wall element shown in phantom when the two wall elements 1, 3 are mounted back-to-back. FIG. 10 is a partial side view illustrating the two wall elements mounted back-to-back as illustrated in FIG. 6.

Figure 7:
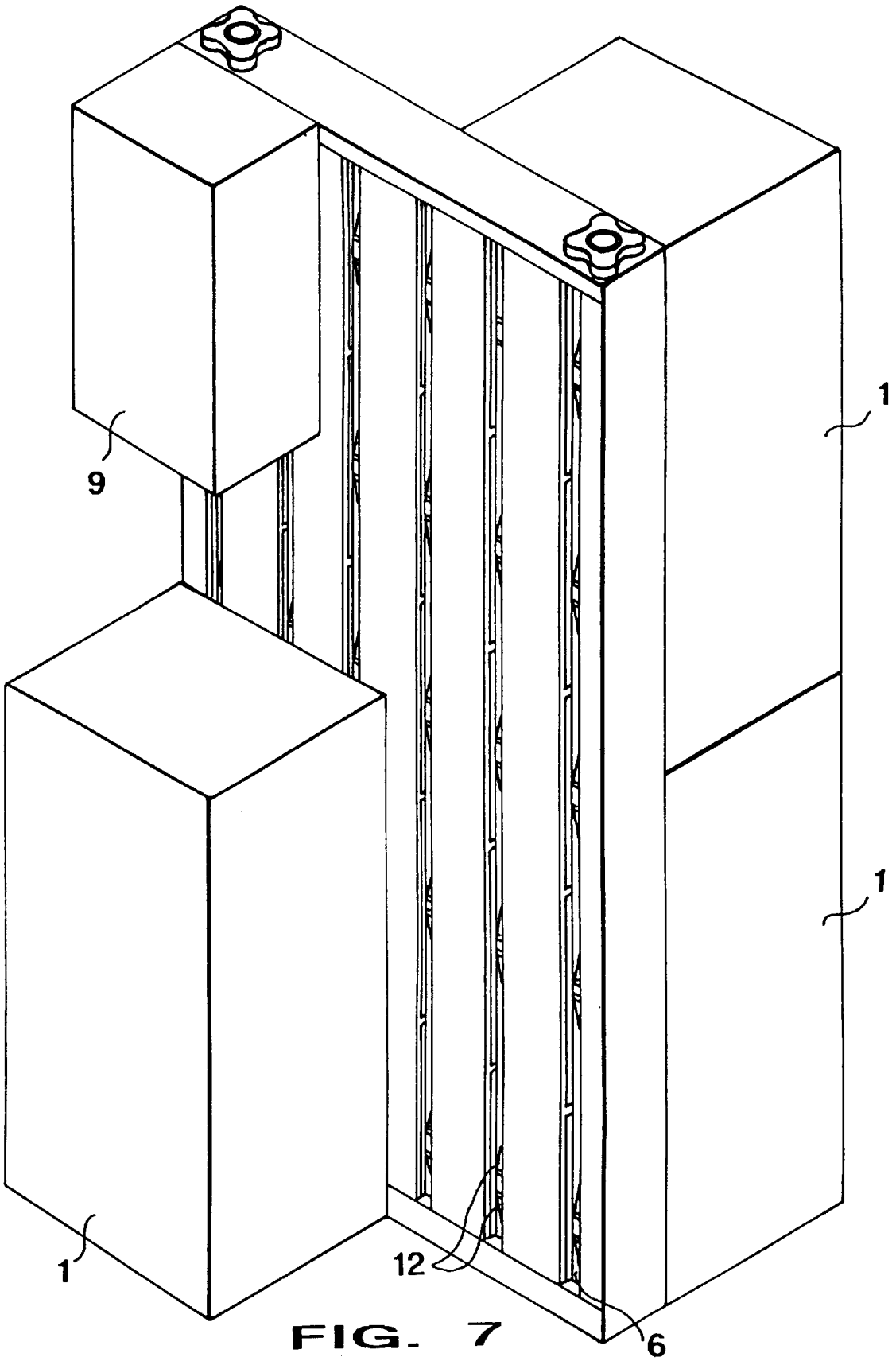
FIG. 7 illustrates an in-door setting with a wall element and mounted fittings.
Figure 8:
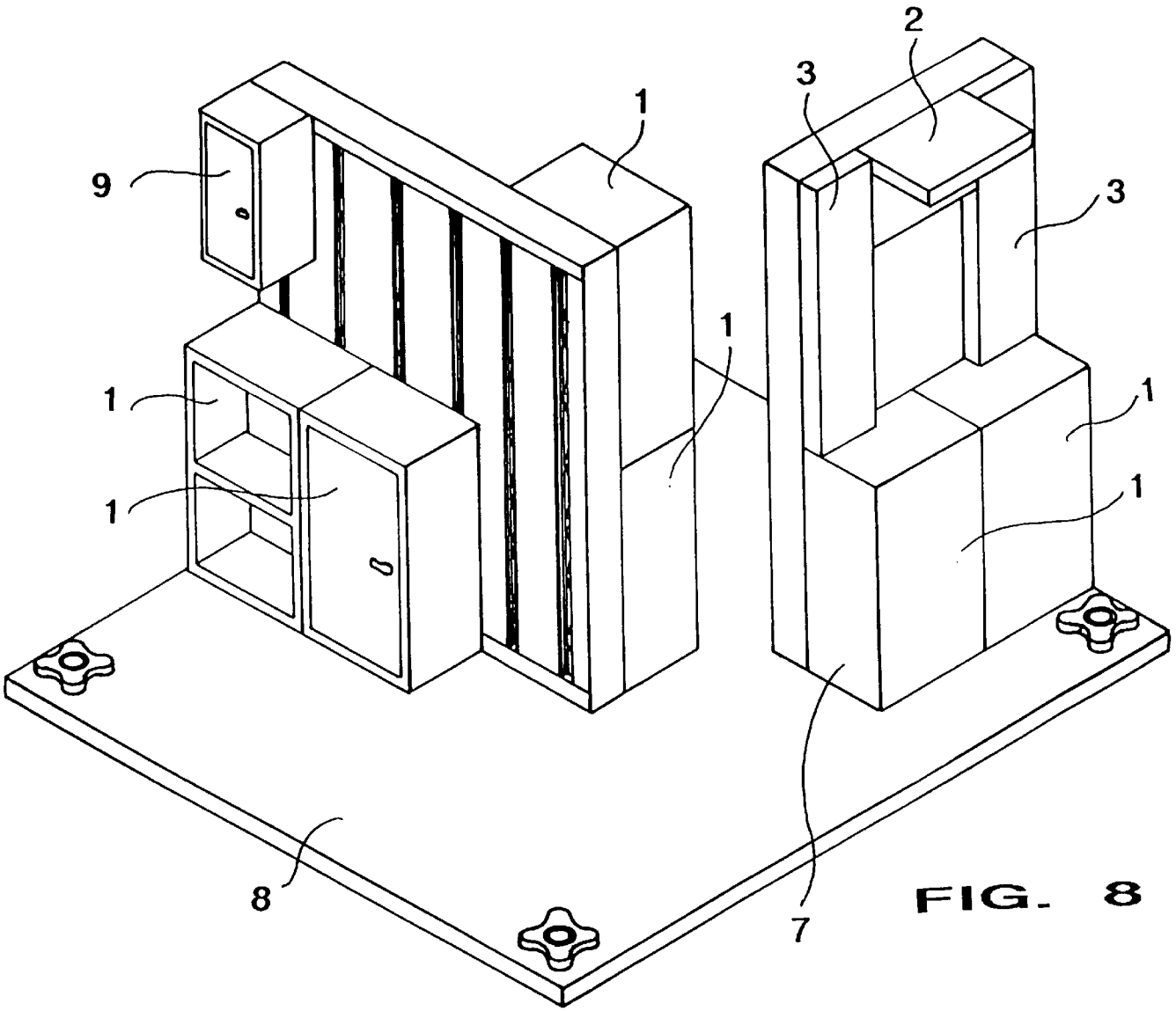
FIG. 8 illustrates an alternative in-door setting with a bottom plate, two wall elements and mounted fittings.

The arrangement illustrated in FIG. 6 thus constitutes a solidly combined unit since the shelf element 2 connects the two box-shaped fittings 1. FIG. 7 also illustrates how the fittings may be mounted on a wall element 7 whereby an in-door setting is produced. Herein it is shown how the backs of the wall elements are provided with two fittings 1 of the type shown in FIG. 1, and how their fronts are provided with a corresponding fitting 1 at the bottom. Thus, use of the wall element 7 enables the fittings to be interconnected on top of each other to form high cupboards as well as freely suspended single cupboards, illustrated by the fitting 8. FIG. 8 then illustrates how more complex in-door settings may be formed by mounting such in-door settings on a bottom plate. In this case the mounting on the bottom plate is made possible by providing the bottom plate with coupling studs which, in a manner known per se, are arranged for coupling with complementary coupling means on the underside of the fittings or the wall elements.

Thus, the invention provides a toy building system which enables construction of small groupings consisting exclusively of fittings, as well as in-door settings having more or less complex structures.

It is obvious that a wide variety of alternative embodiments are possible; thus, e.g. the coupling means may have many different designs and the dimensions and designs of bottom plates as well as wall elements and furniture elements may be varied as desired. As will appear from FIGS. 4, 7 and 8, the upper portion of the wall elements may be provided with coupling means, in this case in the form of coupling studs which allow laterally consecutive interconnecting of the wall elements or perpendicular interconnecting in a commonly known manner by means of a separate coupling element (not shown). These coupling studs also enable the wall elements to be interconnected directly on top of each other provided the underside of the wall elements are provided with complementary coupling elements (not shown) for coupling with the coupling studs on the top surface of the wall elements.

We clam:

1. A toy building system, comprising:

a number of fittings (1, 2, 3) with a top surface, a bottom surface and a number of lateral walls, including a front with functional parts, and a back (4);

wherein each fitting (1, 2, 3) has at least two functionally identical coupling means (5, 6) being provided only on the back thereof, said at least two coupling means (5, 6) including a protruding coupling means (5) that protrude a distance from the back (4) of the fitting (1, 2, 3), and wherein the at least two coupling means (5, 6) are arranged at a mutual modular distance and provided in such a manner that the fittings (1, 2, 3) are adapted to be interconnected with the at least two functionally identical coupling means (5, 6) on the back of another of said fittings in at least two different positions relative to each other.

2. A toy building system according to claim 1, wherein the at least two coupling means (5, 6) are arranged at a fixed mutual modular distance at the back (4) of the fitting along at least one line which is substantially parallel with the lateral walls, said lateral walls being adjacent to the back (4).

3. A toy building system according to claim 1, wherein the at least two coupling means (5, 6) are arranged at a mutually fixed modular distance at the back (4) of the fitting, said mutually fixed modular distance lying along at least one line which is substantially parallel with the top surface and bottom surface of the fitting.

4. A toy building system according to claim 2, wherein the toy building system further comprises at least one fitting (1) where the at least two coupling means (5, 6) constitute at least four sets of functionally identical coupling groups arranged in a rectangular pattern.

5. A toy building system according to claim 4, wherein the coupling groups are arranged so that the distance from one coupling group to the nearest of the top surface, the bottom surface and the lateral walls that abuts on the back (4) substantially corresponds to half the modular distance.

6. A toy building system according to claim 1, wherein the at least two coupling means (5,6) on the backs (4) of the fittings are self-complementary, whereby two fittings with identical coupling means (5,6) may be interconnected back to back.

7. A toy building system according to claim 1, further comprising a number of wall elements (7), and wherein the fittings (1,2,3) and the wall elements (7) are provided with mutually complementary coupling means (5,6) arranged for releasable coupling of the fittings (1,2,3) onto the wall elements (7).

8. A toy building system according to claim 1, further comprising a number of building plates (8) each having building plate coupling means, and wherein the bottom surfaces of the fittings (1, 2, 3) have bottom surface coupling means complementary to the building plate coupling means arranged for releasable coupling of the fittings onto the building plates.

9. A toy building system according to claim 8, wherein a modular distance between the at least two coupling means (5, 6) for interconnecting the fittings (1, 2, 3) and for coupling the fittings (1, 2, 3) onto the wall elements in a direction parallel to the bottom surface of the fitting (1, 2, 3) is the same as the modular distance of the building plate coupling elements on the building plates.

10. A toy building system according to claim 7, wherein the wall elements (7) and the building plates (8) constitute a part of a doll house construction.

* * * * *

UNITED STATES PATENT AND TRADEMARK OFFICE

CERTIFICATE OF CORRECTION

PATENT NO. : 5,910,037

DATED : June 8, 1999

INVENTOR(S) : Bach et al.

It is certified that error appears in the above-identified patent and that said Letters Patent is hereby corrected as shown below:

On the title page;

After Item [22], please insert the following:

[30] Foreign Application Priority Data

November 20, 1995 [DK] Denmark.....1300 / 95

Signed and Sealed this

Sixteenth Day of November, 1999

*Attest:*

Q. TODD DICKINSON

*Attesting Officer*

*Acting Commissioner of Patents and Trademarks*